US011053617B2

(12) United States Patent
Tam et al.

(10) Patent No.: US 11,053,617 B2
(45) Date of Patent: Jul. 6, 2021

(54) BALLISTIC RESISTANT THERMOPLASTIC SHEET, PROCESS OF MAKING AND ITS APPLICATIONS

(71) Applicant: HONEYWELL INTERNATIONAL INC., Morris Plains, NJ (US)

(72) Inventors: Thomas Tam, Chesterfield, VA (US); Mark Benjamin Boone, Mechanicsville, VA (US); Ashok Bhatnagar, Richmond, VA (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 16/700,140

(22) Filed: Dec. 2, 2019

(65) Prior Publication Data

US 2020/0255986 A1 Aug. 13, 2020

Related U.S. Application Data

(62) Division of application No. 16/001,283, filed on Jun. 6, 2018, now Pat. No. 10,494,746, which is a division (Continued)

(51) Int. Cl.
*D04H 3/115* (2012.01)
*D03D 1/00* (2006.01)

(Continued)

(52) U.S. Cl.
CPC ..... *D04H 3/115* (2013.01); *D03D 1/0052* (2013.01); *D03D 15/46* (2021.01); *D03D 15/47* (2021.01);

(Continued)

(58) Field of Classification Search
CPC ..... D03D 1/0052; D03D 15/0027; D03D 15/0088; D03D 15/46; D03D 15/47; D06C 7/00; Y10T 442/30; Y10T 442/3146; Y10T 428/24124; D10B 2401/041; B29C 70/22; B29C 70/224; B29C 70/226; D04H 3/115; D04H 3/12; D04H 3/14; D04H 3/147; D04H 3/153
See application file for complete search history.

(56) References Cited

U.S. PATENT DOCUMENTS 4,457,985 A 7/1984 Harpell et al.
4,680,213 A 7/1987 Fourezon (Continued)

FOREIGN PATENT DOCUMENTS

EP 0747518 12/1996
EP 1908581 A1 * 4/2008 ..... D03D 1/0052

(Continued)

OTHER PUBLICATIONS

Definition of "fusion" from Merriam-Webster.com date uknown.*

(Continued)

*Primary Examiner* — John L Goff, II
(74) *Attorney, Agent, or Firm* — Roberts & Roberts, LLP; Richard S. Roberts, Jr.

(57) ABSTRACT

Woven fabrics are formed from high tenacity fibers or tapes that are loosely interwoven with adhesive coated filaments, to composite articles formed therefrom, and to a continuous process for forming the composite articles.

8 Claims, 3 Drawing Sheets

Related U.S. Application Data of application No. 14/996,391, filed on Jan. 15, 2016, now Pat. No. 9,994,977, which is a division of application No. 13/835,489, filed on Mar. 15, 2013, now Pat. No. 9,243,355.

(51) Int. Cl.

| | |
|---|---|
| ***D06C 7/00*** | (2006.01) |
| ***D03D 15/46*** | (2021.01) |
| ***D03D 15/47*** | (2021.01) |

(52) U.S. Cl.

CPC ..... *D06C 7/00* (2013.01); *D10B 2401/041* (2013.01); *Y10T 428/24124* (2015.01); *Y10T 442/30* (2015.04); *Y10T 442/3146* (2015.04)

(56) References Cited

U.S. PATENT DOCUMENTS

| | | | | |
|---|---|---|---|---|
| 4,748,064 | A | 5/1988 | Harpell et al. | |
| 5,102,725 | A | 4/1992 | Knox et al. | |
| 5,280,546 | A | 1/1994 | Machida et al. | |
| 5,724,670 | A | 3/1998 | Price | |
| 5,804,015 | A | 9/1998 | McCarter et al. | |
| 6,127,291 | A * | 10/2000 | Coppage, Jr. ..... | F41H 5/0485 2/2.5 |
| 6,610,618 | B1 | 8/2003 | Bottger et al. | |
| 7,514,378 | B2 | 4/2009 | Howland | |
| 7,910,503 | B2 | 3/2011 | Krueger et al. | |
| 7,964,261 | B2 | 6/2011 | Backer et al. | |
| 7,964,266 | B2 | 6/2011 | Harding et al. | |
| 7,964,518 | B1 | 6/2011 | Bhatnagar et al. | |
| 7,993,715 | B2 | 8/2011 | Geva et al. | |
| 8,168,022 | B2 | 5/2012 | Backer et al. | |
| 8,349,112 | B2 | 1/2013 | Backer et al. | |
| 2002/0034624 | A1 | 3/2002 | Harpell et al. | |
| 2002/0164912 | A1 | 11/2002 | Fawcett et al. | |
| 2003/0008583 | A1 | 1/2003 | Chiou | |
| 2006/0035078 | A1 | 2/2006 | Tam et al. | |
| 2006/0252325 | A1 | 11/2006 | Matsumura et al. | |
| 2007/0116928 | A1 * | 5/2007 | Monnerie ..... | D04H 3/07 428/147 |
| 2009/0311930 | A1 | 12/2009 | Wang et al. | |
| 2010/0124862 | A1 | 5/2010 | Smith | |
| 2010/0275764 | A1 | 11/2010 | Egres | |
| 2010/0316838 | A1 | 12/2010 | Krummel | |
| 2010/0317248 | A1 | 12/2010 | Chang et al. | |
| 2011/0097021 | A1 | 4/2011 | Curran et al. | |
| 2011/0174147 | A1 | 7/2011 | Steeman et al. | |
| 2011/0256341 | A1 | 10/2011 | Geva et al. | |
| 2011/0269359 | A1 | 11/2011 | Tam et al. | |
| 2012/0085224 | A1 | 4/2012 | Jongedijk et al. | |
| 2012/0128947 | A1 | 5/2012 | Bohringer | |
| 2012/0189805 | A1 | 7/2012 | Backer et al. | |
| 2014/0273696 | A1 | 9/2014 | Tam et al. | |

FOREIGN PATENT DOCUMENTS

| | | |
|---|---|---|
| WO | 2006045256 | 5/2006 |
| WO | 2009141276 | 11/2009 |

OTHER PUBLICATIONS

Moss et al. "Effects of weave type on the ballistic performance of fabrics." AIAA Journal, v 50, n. 11, p. 2558-2565, Nov. 2012; ISSN: 00011452; DOI: 10.2514/1.J051708; American Institute of Aeronautics and Astronautics Inc.

Phoenix et al. "New Interference Approach for Ballistic Impact into Stacked Flexible Composite Body Armor." AIAA Journal, v 48, n. 2, p. 490-501, Feb. 2010; ISSN: 00011452; DOI: 10.2514/1.45362; American Institute of Aeronautics and Astronautics Inc.

Lee et al. "Failure of Spectraqq* polyethylene fiber-reinforced composites under ballistic impact loading." Journal of Composite Materials, v 28, n. 13, p. 1202-1226, 1994; ISSN: 00219983; Technomic Publ Co Inc.

Chen et al., "Ballistic Resistance Analysis of High Strength Fibers With Different Combination," Chung Cheng Institute of Technology; vol. 37, No. 2, p. 33-42 (English translation pp. 1-18); May 2009; Taiwan.

International Search Report and Written Opinion of the International Searching Authority for Corresponding Application PCT/US2014/023850.

* cited by examiner

BALLISTIC RESISTANT THERMOPLASTIC SHEET, PROCESS OF MAKING AND ITS APPLICATIONS

CROSS-REFERENCE TO RELATED APPLICATIONS

This application is a Divisional of U.S. application Ser. No. 16/001,283, filed Jun. 6, 2018, now U.S. Pat. No. 10,494,746 which issued on Dec. 3, 2019, which is a Divisional of U.S. application Ser. No. 14/996,391 filed Jan. 15, 2016, now U.S. Pat. No. 9,994,977 which issued on Jun. 12, 2018, which is a Divisional of U.S. application Ser. No. 13/835,489, filed Mar. 15, 2013, now U.S. Pat. No. 9,243,355 which issued on Jan. 26, 2016, all the disclosures of which are incorporated by reference herein.

BACKGROUND

Technical Field

This technology relates to closed woven composite articles formed by thermally fusing an open woven fabric formed from high tenacity, thermoplastic elongate bodies that are loosely interwoven with binding fibers, and to a continuous process for forming the composite articles.

Description of the Related Art

High tenacity fibers, such as SPECTRA® polyethylene fibers or aramid fibers such as KEVLAR® and TWARON® fibers, are known to be useful for the formation of articles having excellent ballistic resistance. Ballistic resistant articles formed from high tenacity tapes are also known. Articles such as bullet resistant vests, helmets, vehicle panels and structural members of military equipment are typically made from fabrics comprising high tenacity fibers or tapes because of their very high strength to weight performance. For many applications, the fibers or tapes may be formed into woven or knitted fabrics. For other applications, the fibers or tapes may be encapsulated or embedded in a polymeric matrix material and formed into non-woven fabrics. In one common non-woven fabric structure, a plurality of unidirectionally oriented fibers are arranged in a generally coplanar, coextensive relationship and coated with a binding matrix resin to bind the fibers together. Typically, multiple plies of such unidirectionally oriented fibers are merged into a multi-ply composite. See, for example, U.S. Pat. Nos. 4,403,012; 4,457,985; 4,613,535; 4,623,574; 4,650,710; 4,737,402; 4,748,064; 5,552,208; 5,587,230; 6,642,159; 6,841,492; and 6,846,758, all of which are incorporated herein by reference to the extent consistent herewith.

Composites fabricated from non-woven fabrics are known to stop projectiles better than woven fabric composites because the component fibers in non-woven fabrics are not crimped like the fibers in woven materials. Fiber crimping reduces the ability of the fibers to stay in tension and immediately absorb the energy of a projectile, compromising their effectiveness. In addition, projectile damage to non-woven fabrics is more localized compared to woven fabrics, allowing for enhanced multi-hit performance. However, non-woven composite technology remains imperfect. Traditional non-woven composites are not ideal because the resin coating that is generally necessary to keep the component fibers bound together is present in place of a greater quantity of high tenacity fibers. The reduction in overall fiber content reduces the maximum achievable ballistic resistance efficiency on an equal weight basis relative to fabrics incorporating no resin coating. However, it is difficult to produce single-ply sheets of unidirectionally oriented fibers with adequate mechanical integrity when less than 10% by weight of bonding resin is used.

In addition, to maximize ballistic resistance, it is desired for there to be a bare minimum of space between adjacent fibers to facilitate maximum engagement of the fibers with a projectile threat. One way to accomplish that is by adding more fibers to a fibrous layer, but that makes the armor heavier, which is undesirable. A more preferred method is spreading filaments apart to form thinner fiber layers having fewer fibers that lie on top of each other. This allows a greater number of fiber layers to be stacked on top of each other without altering the expected fabric thickness, thereby enhancing fiber engagement with projectile threats without increasing fabric weight. However, it is difficult to produce single-ply sheets of unidirectionally oriented fibers with adequate mechanical integrity when the filaments of the fibers are spread very thinly.

One method of addressing this problem of inadequate mechanical integrity during composite fabrication is to use a release paper carrier sheet during processing. In a typical process, an array of unidirectionally oriented parallel fibers is coated with a binder resin and then the coated fibers are contacted with a silicone-coated release paper while the resin is still wet. The coating is then dried and the release paper is removed. However, this method also has associated disadvantages and it is desired to avoid the use of a carrier sheet in the manufacturing process.

Accordingly, there is an ongoing need in the art for an improved ballistic resistant composite that combines the superior mechanical strength of woven fabrics with the superior ballistic resistance of non-woven fabrics.

In this regard, U.S. Pat. No. 8,349,112 teaches a method of weaving polymeric tapes together with binding threads, with the polymeric tapes being used as warp yarn and a binding thread being used as weft yarn or with the polymeric tapes being used as weft yarn and a binding thread being used as warp yarn, followed by consolidating multiple layers with sufficient heat to melt the binding threads. The melting deforms the binding threads, distributing the resin around the non-melted polymeric tapes, thereby acting as an adhesive coating. This eliminates the undulations caused by the weaving process. However, this method does not produce articles having less than 10% resin content with sufficient mechanical integrity. U.S. Pat. No. 8,349,112 is silent with regard to binding resin content, but the thermal destruction of the binder fibers compromises the fabric breaking strength in the direction transverse to the polymeric tapes. The melting of the binder fibers eliminates the mechanical interlocking of warp and weft fibers created by the weaving process, resulting in a non-woven fabric with the binder polymer serving as a conventional adhesive coating. This resulting fabric either has greater than 10% resin content or less than 10% resin content and inadequate mechanical integrity, thereby failing to improve upon prior art composites. Accordingly, U.S. Pat. No. 8,349,112 fails to achieve the objectives of the present invention.

U.S. Pat. No. 4,680,213 teaches structures where non-thermoplastic, reinforcing textile yarns are bonded by adhesion with binding yarns disposed transverse to the textile yarns. The reinforcing textile yarns are spaced apart from each other and the binding yarns are spaced apart from each other, so as to form permanent holes in their laminates. This type of open structure is unacceptable for anti-ballistic applications, and is not described as having utility as a ballistic resistant composite.

Accordingly, there is an ongoing need in the art for a ballistic resistant composite containing less than 10% binder resin and having reduced thickness that combines the superior mechanical strength of woven fabrics with the superior ballistic resistance of non-woven fabrics. The present invention provides a solution to this need.

SUMMARY

The invention provides a woven fabric comprising high tenacity elongate bodies interwoven and bonded with transversely disposed binding elongate bodies, said high tenacity elongate bodies comprising a thermoplastic polymer, having a tenacity of at least about 14 g/denier and having a tensile modulus of at least about 300 g/denier, wherein immediately adjacent high tenacity elongate bodies are spaced apart from each other by a distance equivalent to at least about 10% of the width of the high tenacity elongate bodies; and wherein said binding elongate bodies at least partially comprise a thermoplastic polymer having a melting temperature below a melting temperature of the high tenacity elongate bodies.

The invention also provides closed, thermally fused sheets and multilayer ballistic resistant articles formed from such sheets.

The invention still further provides a process for forming a dimensionally stable open fabric, the process comprising:

a) providing a woven fabric comprising high tenacity elongate bodies interwoven with transversely disposed binding elongate bodies, said high tenacity elongate bodies comprising a thermoplastic polymer, having a tenacity of at least about 14 g/denier and having a tensile modulus of at least about 300 g/denier, wherein immediately adjacent high tenacity elongate bodies are spaced apart from each other by a distance equivalent to at least about 10% of the width of the high tenacity elongate bodies; and wherein said binding elongate bodies at least partially comprise a thermoplastic polymer having a melting temperature below a melting temperature of the high tenacity elongate bodies;

b) at least partially melting the thermoplastic polymer of the binding elongate bodies; and c) allowing the melted thermoplastic polymer of the binding elongate bodies to solidify, whereby the binding elongate bodies are bonded to the high tenacity elongate bodies, thereby forming a dimensionally stable open fabric.

Also provided is a process for forming a closed, thermally fused multilayer article comprising:

a) providing an open woven fabric comprising high tenacity elongate bodies interwoven and bonded with transversely disposed binding elongate bodies, said high tenacity elongate bodies comprising a thermoplastic polymer, having a tenacity of at least about 14 g/denier and having a tensile modulus of at least about 300 g/denier, wherein immediately adjacent high tenacity elongate bodies are spaced apart from each other by a distance equivalent to at least about 10% of the width of the high tenacity elongate bodies; and wherein said binding elongate bodies at least partially comprise a thermoplastic polymer having a melting temperature below a melting temperature of the high tenacity elongate bodies;

b) providing a closed, fused sheet formed from a woven fabric, said open fabric comprising high tenacity elongate bodies interwoven and bonded with transversely disposed binding elongate bodies, said high tenacity elongate bodies comprising a thermoplastic polymer, having a tenacity of at least about 14 g/denier and having a tensile modulus of at least about 300 g/denier, wherein said binding elongate bodies at least partially comprise a thermoplastic polymer having a melting temperature below a melting temperature of the high tenacity elongate bodies, wherein the closed, fused sheet has substantially no gaps between immediately adjacent high tenacity elongate bodies and wherein said immediately adjacent high tenacity elongate bodies do not overlap;

c) adjoining the open woven fabric and the closed, fused sheet together wherein the high tenacity elongate bodies of the first fabric are oriented at a non-parallel angle relative to the high tenacity elongate bodies of the second fabric; and d) thermally pressing the adjoined woven fabric and fused sheet together under conditions sufficient to attach the woven fabric to the fused sheet and to flatten the high tenacity elongate bodies in the woven fabric, thereby causing the longitudinal edges of the immediately adjacent high tenacity elongate bodies in the woven fabric to contact each other, whereby there are substantially no gaps between said immediately adjacent high tenacity elongate bodies and wherein said immediately adjacent high tenacity elongate bodies do not overlap.

Also provided is a process for forming a closed, thermally fused multilayer article comprising adjoining an open, woven fabric with a web comprising a parallel array of high tenacity elongate bodies, wherein the high tenacity elongate bodies of the web are positioned perpendicular to the high tenacity elongate bodies of the woven fabric, and thermally pressing the adjoined woven fabric and web under conditions sufficient to attach the woven fabric to the web and to flatten the high tenacity elongate bodies of both the woven fabric and the web respectively, thereby causing longitudinal edges of the immediately adjacent high tenacity elongate bodies in the woven fabric and the web respectively to contact each other, whereby there are substantially no gaps between said immediately adjacent high tenacity elongate bodies and wherein said immediately adjacent high tenacity elongate bodies do not overlap.

Still further provided is a process for forming a closed, thermally fused multilayer article comprising adjoining a closed, fused sheet with a web comprising a parallel array of high tenacity elongate bodies, wherein the high tenacity elongate bodies of the web are positioned perpendicular to the high tenacity elongate bodies of the fused sheet, and thermally pressing the adjoined fused sheet and web under conditions sufficient to attach the fused sheet to the web and to flatten the high tenacity elongate bodies of the web, thereby causing longitudinal edges of the immediately adjacent high tenacity elongate bodies in the web to contact each other whereby there are substantially no gaps between said immediately adjacent high tenacity elongate bodies and wherein said immediately adjacent high tenacity elongate bodies do not overlap.

DETAILED DESCRIPTION

Figure 1:
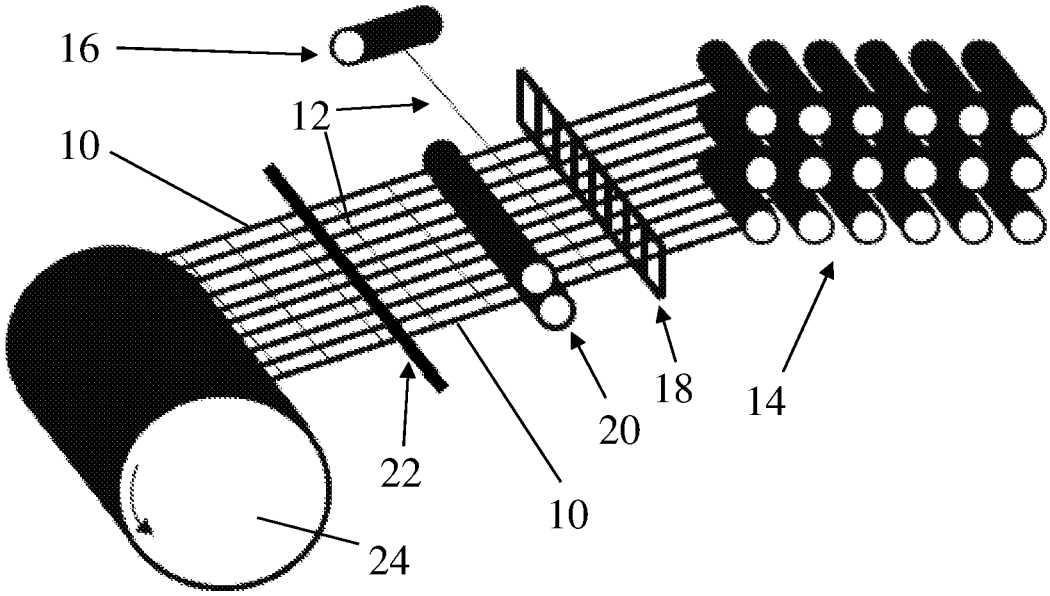
FIG. 1 is a perspective-view schematic representation of a woven fabric having high tenacity elongate bodies in the longitudinal warp direction and binding elongate bodies transversely disposed in the lateral weft direction.

As illustrated in FIGS. 1-4, high strength composite sheets are fabricated by interweaving high tenacity elongate bodies with transversely disposed binding elongate bodies. As used herein, "elongate bodies" are bodies having a length dimension that is much greater than the transverse dimensions of width and thickness. Such includes monofilaments, untwisted multifilament fibers (i.e. untwisted yarns) that are fused or unfused, twisted multifilament fibers (i.e. twisted yarns) that are fused or unfused, untwisted thermally fused multifilament tape, or non-fibrous polymeric tape.

As used herein, a "high tenacity" elongate body is one having a tenacity of at least about 14 g/denier, more preferably about 20 g/denier or more, still more preferably about 25 g/denier or more, still more preferably about 30 g/denier or more, still more preferably about 40 g/denier or more, still more preferably about 45 g/denier or more, and most preferably about 50 g/denier or more. Such high tenacity elongate bodies also have a tensile modulus of at least about 300 g/denier, more preferably about 400 g/denier or more, more preferably about 500 g/denier or more, still more preferably about 1,000 g/denier or more and most preferably about 1,500 g/denier or more. The high tenacity elongate bodies also have an energy-to-break of at least about 15 J/g or more, more preferably about 25 J/g or more, more preferably about 30 J/g or more and most preferably have an energy-to-break of about 40 J/g or more. Methods of forming elongate bodies having these combined high strength properties are conventionally known in the art.

The term "denier" refers to the unit of linear density, equal to the mass in grams per 9000 meters of fiber/tape. The term "tenacity" refers to the tensile stress expressed as force (grams) per unit linear density (denier) of an unstressed specimen. The "initial modulus" is the property of a material representative of its resistance to deformation. The term "tensile modulus" refers to the ratio of the change in tenacity, expressed in grams-force per denier (g/d) to the change in strain, expressed as a fraction of the original fiber/tape length (in/in).

As used herein, the term "tape" refers to a flat, narrow, monolithic strip of material having a length greater than its width and an average cross-sectional aspect ratio, i.e. the ratio of the greatest to the smallest dimension of cross-sections averaged over the length of the tape article, of at least about 3:1. A tape may be a fibrous material or a non-fibrous material. A "fibrous material" comprises one or more filaments. The cross-section of a polymeric tape of the invention may be rectangular, oval, polygonal, irregular, or of any shape satisfying the width, thickness and aspect ratio requirements outlined herein.

Such tapes preferably have a substantially rectangular cross-section with a thickness of about 0.5 mm or less, more preferably about 0.25 mm or less, still more preferably about 0.1 mm or less and still more preferably about 0.05 mm or less. In the most preferred embodiments, the polymeric tapes have a thickness of up to about 3 mils (76.2 μm), more preferably from about 0.35 mil (8.89 μm) to about 3 mils (76.2 μm), and most preferably from about 0.35 mil to about 1.5 mils (38.1 μm). Thickness is measured at the thickest region of the cross-section.

Polymeric tapes useful in the invention have preferred widths of from about 2.5 mm to about 50 mm, more preferably from about 5 mm to about 25.4 mm, even more preferably from about 5 mm to about 20 mm, and most preferably from about 5 mm to about 10 mm. These dimensions may vary but the polymeric tapes formed herein are most preferably fabricated to have dimensions that achieve an average cross-sectional aspect ratio, i.e. the ratio of the greatest to the smallest dimension of cross-sections averaged over the length of the tape article, of greater than about 3:1, more preferably at least about 5:1, still more preferably at least about 10:1, still more preferably at least about 20:1, still more preferably at least about 50:1, still more preferably at least about 100:1, still more preferably at least about 250:1 and most preferred polymeric tapes have an average cross-sectional aspect ratio of at least about 400:1.

Polymeric tapes are formed by conventionally known methods, such as extrusion, pultrusion, slit film techniques, etc. For example, a unitape of standard thickness may be cut or slit into tapes having the desired lengths, which is a desired method for producing tapes from multi-ply non-woven fiber layers. An example of a slitting apparatus is disclosed in U.S. Pat. No. 6,098,510 which teaches an apparatus for slitting a sheet material web as it is wound onto said roll. Another example of a slitting apparatus is disclosed in U.S. Pat. No. 6,148,871, which teaches an apparatus for slitting a sheet of a polymeric film into a plurality of film strips with a plurality of blades. The disclosures of both U.S. Pat. Nos. 6,098,510 and 6,148,871 are incorporated herein by reference to the extent consistent herewith. Other exemplary methods are described in U.S. Pat. Nos. 7,300,691; 7,964,266 and 7,964,267, which are incorporated herein by reference to the extent consistent herewith. It is also known to form narrow tape structures by weaving thin strips of fabric, which generally may be accomplished by adjusting the settings on any conventional weaving machine, such as those disclosed in U.S. Pat. Nos. 2,035,138; 4,124,420; 5,115,839, which are incorporated by reference herein to the extent consistent herewith, or by use of a ribbon loom specialized for weaving narrow woven fabrics or ribbons. Useful ribbon looms are disclosed, for example, in U.S. Pat. Nos. 4,541,461; 5,564,477; 7,451,787 and 7,857,012, each of which is assigned to Textilma AG of Stansstad, Switzerland, and each of which is incorporated herein by reference to the extent consistent herewith, although any alternative ribbon loom is equally useful.

Elongate bodies of the invention also include filaments, fibers and yarns. Fibers and yarns are distinguished from filaments in that fibers and yarns are formed from filaments. A fiber may be formed from just one filament or from multiple filaments. A fiber formed from just one filament is referred to either as a "single-filament" fiber or a "monofilament" fiber, and a fiber formed from a plurality of filaments is referred to as a "multi-filament" fiber. A "yarn" is defined as a single strand consisting of multiple filaments, analogous to a multi-filament fiber. The cross-sections of fibers, filaments and yarns may vary and may be regular or irregular, including circular, flat or oblong cross-sections.

The high tenacity elongate bodies may comprise any conventionally known thermoplastic polymer type having a tenacity of at least about 14 g/denier and a tensile modulus of at least about 300 g/denier. Particularly suitable are elongate bodies formed from polyolefins, including polyethylene and polypropylene; polyesters, including polyethylene terephthalate, polypropylene terephthalate, and polybutylene terephthalate; polyamides; polyphenylenesulfide; gel spun polyvinyl alcohol (PVA); gel spun polytetrafluoroethylene (PTFE); and the like. Particularly preferred are extended chain polyolefin elongate bodies, such as highly oriented, high molecular weight polyethylene, particularly ultra-high molecular weight polyethylene (UHMW PE) elongate bodies, and ultra-high molecular weight polypropylene elongate bodies. Each of these elongate body types described above is conventionally known in the art. Also suitable for producing polymeric elongate bodies are copolymers, block polymers and blends of the above materials. For example, useful elongate bodies may be formed from multi-filament elements comprising at least two different filament types, such as two different types of UHMW PE filaments or a blend of polyester filaments and UHMW PE filaments.

Thermoplastic high tenacity elongate bodies are most suitable herein because they are capable of being deformed by thermal, solid state deformation. Such excludes non-thermoplastic synthetic fibers such as carbon fibers, aramid fibers, glass fibers, polyacrylic fibers, aromatic polyamide fibers, aromatic polyester fibers, polyimide fibers, etc.

Specifically most preferred are elongate bodies formed from ultra high molecular weight polyethylene. Ultra high molecular weight polyethylene filaments, fibers and yarns are formed from extended chain polyethylenes having molecular weights of at least 300,000, preferably at least one million and more preferably between two million and five million. Such extended chain polyethylene fibers/yarns may be grown in solution spinning processes such as described in U.S. Pat. No. 4,137,394 or 4,356,138, which are incorporated herein by reference, or may be spun from a solution to form a gel structure, such as described in U.S. Pat. Nos. 4,413,110; 4,536,536; 4,551,296; 4,663,101; 5,006,390; 5,032,338; 5,578,374; 5,736,244; 5,741,451; 5,958,582; 5,972,498; 6,448,359; 6,746,975; 6,969,553; 7,078,099; 7,344,668 and U.S. patent application publication 2007/0231572, all of which are incorporated herein by reference. Particularly preferred fiber types are any of the polyethylene fibers sold under the trademark SPECTRA® from Honeywell International Inc, including SPECTRA® 900 fibers, SPECTRA® 1000 fibers and SPECTRA® 3000 fibers, all of which are commercially available from Honeywell International Inc. of Morristown, N.J.

The most preferred UHMW PE fibers have an intrinsic viscosity when measured in decalin at 135° C. by ASTM D1601-99 of from about 7 dl/g to about 40 dl/g, preferably from about 10 dl/g to about 40 dl/g, more preferably from about 12 dl/g to about 40 dl/g, and most preferably, from about 14 dl/g to 35 dl/g. The most preferred UHMW PE fibers are highly oriented and have a c-axis orientation function of at least about 0.96, preferably at least about 0.97, more preferably at least about 0.98 and most preferably at least about 0.99. The c-axis orientation function is a description of the degree of alignment of the molecular chain direction with the filament direction. A polyethylene filament in which the molecular chain direction is perfectly aligned with the filament axis would have an orientation function of 1. C-axis orientation function ($f_c$) is measured by the wide angle x-ray diffraction method described in Correale, S. T. & Murthy, Journal of Applied Polymer Science. Vol. 101, 447-454 (2006) as applied to polyethylene.

When it is desired to utilize twisted elongate bodies, various methods of twisting fibers/yarns are known in the art and any method may be utilized. In this regard, twisted multi-filament tapes are formed by first twisting a feed fiber/yarn precursor, followed by compressing the twisted precursor into a tape. Useful twisting methods are described, for example, in U.S. Pat. Nos. 2,961,010; 3,434,275; 4,123,893; 4,819,458 and 7,127,879, the disclosures of which are incorporated herein by reference. The fibers/yarns are twisted to have at least about 0.5 turns of twist per inch of fiber/yarn length up to about 15 twists per inch, more preferably from about 3 twists per inch to about 11 twists per inch of fiber/yarn length. In an alternate preferred embodiment, the fibers/yarns are twisted to have at least 11 twists per inch of fiber/yarn length, more preferably from about 11 twists per inch to about 15 twists per inch of fiber/yarn length. The standard method for determining twist in twisted yarns is ASTM D1423-02.

When it is desired to utilize fused elongate bodies, various methods of fusing fibers/yarns are known in the art and any method may be utilized. As with twisting, fused multi-filament tapes are formed by first fusing a feed fiber/yarn precursor followed by compressing the fused precursor into a tape. In this regard, fusion of the fiber/yarn filaments may be accomplished by with the use of heat and tension, or through application of a solvent or plasticizing material prior to exposure to heat and tension as described in U.S. Pat. Nos. 5,540,990; 5,749,214; and 6,148,597, which are hereby incorporated by reference to the extent compatible herewith. Fusion by bonding may be accomplished, for example, by at least partially coating the filaments with a resin or other polymeric binder material having adhesive properties, such as a polystyrene-polyisoprene-polystyrene-block copolymer resin commercially available from Kraton Polymers of Houston, Tex. under the trademark KRATON® D1107, or any other adhesive polymer described herein. They may also be thermally bonded together without an adhesive coating. Thermal bonding conditions will depend on the fiber type. When the feed fibers/yarns are coated with a resin or other polymeric binder material having adhesive properties to bond the filaments, only a small amount of the resin/binder is needed. In this regard, the quantity of resin/binder applied is preferably no more than 5% by weight based on the total weight of the filaments plus the resin/binder, such that the filaments comprise at least 95% by weight of the coated fiber/yarn based on the total weight of the filaments plus the resin/binder, and the corresponding tape formed from the yarn will thereby also comprise at least 95% by weight of the component filaments. More preferably, the fibers/yarns and tapes comprise at least about 96% filaments by weight, still more preferably 97% filaments by weight, still more preferably 98% filaments by weight, and still more preferably 99% filaments by weight. Most preferably, the fibers/yarns and compressed tapes formed therefrom are resin-free, i.e. are not coated with a bonding resin/binder, and consist essentially of or consist only of filaments.

Methods of compressing twisted fibers/yarns into tapes are described, for example, in U.S. Pat. No. 8,236,119 and U.S. patent application Ser. No. 13/568,097, each of which is incorporated herein by reference to the extent consistent herewith. Other methods for forming tapes, including from twisted multifilament fibers/yarns and from untwisted multifilament fibers/yarns, as well as non-fibrous tapes, are described in U.S. patent application Ser. Nos. 13/021,262; 13/494,641, 13/647,926 and 13/708,360, which are also incorporated herein by reference. These methods are useful for forming tapes of this invention having any of the preferred aspect ratios described herein.

The high tenacity elongate bodies are interwoven with transversely disposed binding elongate bodies. As used herein, a "binding" elongate body is an elongate body that at least partially comprises a heat activated thermoplastic polymer having a melting temperature below a melting temperature of the high tenacity elongate bodies. Said binding elongate bodies may be single component binder element or multi-component elongate bodies. A single component elongate body is a fiber, yarn or tape formed entirely from a heat activated thermoplastic polymer having a melting temperature below a melting temperature of the high tenacity elongate bodies. Such are conventionally known in the art and non-exclusively include bodies comprising ethylene-vinyl acetate, ethylene-acrylate copolymers, styrene block copolymers, polyurethanes, polyamides, polyesters and polyolefins, including and most preferably polyethylene. Multi-component fibers, for example bi-component fibers, are known having multiple distinct cross-sectional domains of distinct polymer types differing from each other in composition (e.g., polyurethane and polyethylene) and/or differing in visual response, e.g., color. Bi-component fibers have two distinct cross-sectional domains of two distinct polymer types. Various types of bi-component fibers are known and include side-by-side fibers, sheath/core fibers (also known as sheathed core fibers) which may be concentric or eccentric, pie wedge fibers, islands/sea fibers and others. Such are well known in the art. Bi-component fibers and methods for their manufacture are described for example in U.S. Pat. Nos. 4,552,603; 4,601,949; and 6,158,204, the disclosures of which are incorporated by reference herein to the extend compatible herewith.

In a preferred embodiment of the invention, the binding elongate bodies comprise bi-component elongate bodies comprising a first component and a second component, wherein the first component comprises a heat activated thermoplastic polymer having a melting temperature below a melting temperature of the high tenacity elongate bodies, and wherein the first component has a melting temperature that is below a melting temperature of second component. Suitable heat activated thermoplastic polymers for the first component non-exclusively includes those described above. Suitable second components comprising a bi-component fiber non-exclusively include the high tenacity polymer types described above. In a most preferred embodiment, the bi-component elongate bodies are sheathed core bi-component fibers, wherein the second polymer component is a core fiber comprising a high tenacity monofilament fiber or a high tenacity multifilament fiber and the first polymer component is a sheath comprising a heat activated, thermoplastic polymer. Preferred heat activated thermoplastic polymers are described above. Preferred core fibers may be any thermoplastic or non-thermoplastic high tenacity fiber, including aramid fibers, carbon fibers, glass fibers, UHMW PE fibers and others. Most preferably, the core fiber is a glass fiber or a UHMW PE fiber.

A most preferred single-component elongate body is a UHMW PE fiber, preferably a monofilament or monofilament-like UHMW PE fiber. A most preferred bi-component elongate body comprises a UHMW PE fiber core (preferably a monofilament or monofilament-like UHMW PE fiber) sheathed with an EVA thermoplastic polymer.

The woven fabric is formed using any commonly known weaving technique where longitudinal warp elongate bodies are interwoven with transversely disposed, lateral weft elongate bodies such that the elongate bodies are in an orthogonal 0°/90° orientation. Plain weave is most common. Other weave types non-exclusively include crowfoot weave, basket weave, satin weave and twill weave.

A first embodiment is illustrated in FIG. 1 where high tenacity elongate bodies 10 are positioned as the longitudinally extending warp bodies and binding elongate bodies 12 are transversely disposed as the lateral weft bodies. In a typical process, the high tenacity elongate bodies 10 are unwound from a plurality of spools that are supported on one or more creels 14. An array of high tenacity elongate bodies 10 is led through a heddle 18 which separates adjacent high tenacity elongate bodies 10 so that they are spaced apart from each other (at their nearest longitudinal edges) by a distance equivalent to at least about 10% of the width of the high tenacity elongate bodies. This amount of separation ensures that the subsequent thermal fusion step preferably achieves a full and complete closure of the space between adjacent high tenacity elongate bodies 10 so that abutting longitudinal edges of the elongate bodies 10 press against each other such that they are substantially in contact with each other without overlapping. Full, complete closure is not mandatory but is most preferred. In this regard, the elongate bodies are typically uniform in width. If not uniform in width, the separation distance should be calculated by measuring the elongate bodies at the location of greatest width. This is the case for all warp and weft fibers of the invention. The subsequent thermal fusion step will accordingly fully close the space between all adjacent high tenacity elongate bodies 10 and achieve a fully closed, gapless woven fabric structure.

In the more preferred embodiments of the invention, the heddle 18 separates adjacent high tenacity elongate bodies 10 so that they are spaced apart at their nearest longitudinal edges by at least about 15% of the width of the high tenacity bodies, still more preferably by about 15% to about 50% of the width of the high tenacity bodies, and most preferably by about 20% to about 30% of the width of the high tenacity bodies. In preferred embodiments of the invention, these width percentages of separation measure to a separation of at least about 0.5 mm, more preferably 1 mm and still more preferably greater than 1 mm, still more by at least about 1.5 mm, still more preferably at least about 2 mm, still more preferably by about 3 mm to about 30 mm and most preferably by about 4 mm to about 20 mm. The separation must be less than about 50% of the width of the high tenacity bodies to ensure that the thermal fusion step fully closes the space between all adjacent high tenacity elongate bodies 10 to achieve a fully closed, gapless woven fabric structure.

Figure 5:
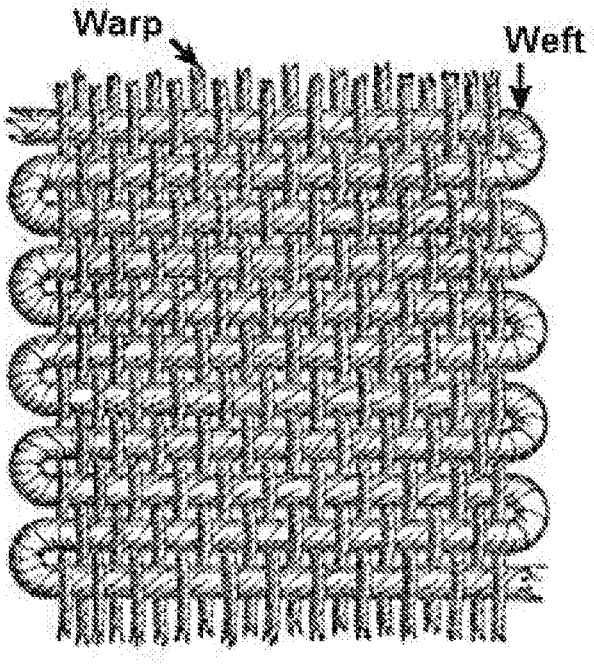
FIG. 5 (PRIOR ART)
FIG. 5 is a perspective-view schematic representation illustrating a conventional plain weave structure having longitudinal warp fibers, lateral weft fibers and selvage loops at its lateral edges.

Referring again to FIG. 1, after the high tenacity elongate bodies 10 pass through the heddle 18, the binding elongate bodies 12 are transversely interwoven with the high tenacity elongate bodies 10 according to standard weaving techniques. The binding elongate bodies 12 are unwound from one or more spools that are supported on one or more creels 16. As illustrated in FIG. 5 which illustrates a typical weaving process, conventional weaving positions one long, continuous weft strand between each pair of adjacent warp strands across the full width of the array of high tenacity elongate bodies 10. After passing the weft strand once across the array of warp strands, the weaving machine turns the weft strand, reversing direction and passing back across the array of warp strands in the opposite direction. As shown in FIG. 5, this forms selvage loops at the side edges of the woven fabric which are typically trimmed or cut off during further processing. When the selvage loops are trimmed or cut off, the resulting structure incorporates a plurality of discontinuous weft bodies in a substantially parallel array. When the selvage loops are not trimmed or cut off, the resulting structure incorporates a single weft elongate body having a plurality of weft body portions where the weft body portions are in a substantially parallel array. For each embodiment of this invention, such weft body portions of one long, continuous weft body that are transversely disposed relative to the longitudinal warp bodies are to be interpreted as being a plurality of lateral weft bodies.

Equally useful in the practice of this invention is an alternative weaving process used when tapes are inserted in the weft direction, whereby the continuous tape is pulled through the warp bodies in only one direction and the inserted tape is then cut at the fabric edge to form the new tape end that will next be pulled through the warp bodies, such that no selvage loops are formed.

The weaving equipment is set to space adjacent binding elongate bodies 12 (such as adjacent parallel portions of one continuous elongate body 12) apart from each other by at least about 2 mm, more preferably from about 3 mm to about 30 mm and most preferably from about 4 mm to about 20 mm. Spacing beyond the maximum spacing limit may result in an open woven fabric having insufficient mechanical strength. Spacing below the minimum spacing limit may result in an open woven fabric having greater than 10% thermoplastic binding resin content. As described herein, only the transversely disposed binding elongate bodies are present in the space between said adjacent high tenacity elongate bodies.

After the binding elongate bodies 12 are woven through the high tenacity elongate bodies 10 in the weft direction, the high tenacity elongate bodies 10 and binding elongate bodies 12 are thermally bonded together at their points of intersection. Such thermal bonding is accomplished by at least partially melting the thermoplastic polymer component of the binding elongate bodies 12 with a heating element 22, thereby activating the thermoplastic polymer so that it is capable of adhering to the high tenacity elongate bodies 10 and then allowing the melted thermoplastic polymer of the binding elongate bodies 12 to solidify. Once the polymer is solidified at the warp-weft body junction point, the binding elongate bodies 12 are bonded to the high tenacity elongate bodies 10, thereby forming a dimensionally stable open fabric.

While heating element 22 is illustrated in FIG. 1 as a rectangular bar that heats by direct contact with the binding bodies 12 (i.e. conductive heating), heating may be accomplished by any suitable method including convective heating (e.g. hot air), radiant heating (e.g. infrared heating) as well as any other means of conductive heating. Heating element 22 preferably heats the binding elongate bodies to a temperature of from about 270° F. (~132° C.) to about 330° F. (~166° C.), more preferably from about 280° F. (~138° C.) to about 320° F. (~160° C.), still more preferably from about 285° F. (~141° C.) to about 315° F. (~157° C.), and most preferably from about 290° F. (~143° C.) to about 310° F. (~154° C.).

This bonding of the bodies at the warp-weft crossing points mechanically stabilizes the open fabric structure by fixing the binding elongate bodies 12 in their position and thereby achieving fixed gaps between the high tenacity elongate bodies 10 that are maintained during fabric handling, preferably such that the dimensions of all gaps in the fabric are identical. The bonding step is also preferably achieved without external pressure. The heat from heating element 22 for bonding is adequate to make the adhesive coating tacky so that the bodies become sufficiently bonded at the warp-weft crossing points with inherent internal pressure of contact between crossing fibers in the woven structure being sufficient to bond the bodies to each other. Avoiding external pressure also ensures that the bond at the warp-weft joint is not permanent but rather is flexible enough to allow gap closing in subsequent thermal pressing. External pressure on the fabric during bonding may be used to reduce the bonding temperature required for adequate bonding, so long as the bonded joints remain flexible and not permanent. Excess, permanent bonding is not desired because it would potentially limit high-tenacity fiber movement during subsequent fabric pressing. This process produces a first dimensionally stable open woven fabric that is preferably wound onto a first storage roll 24 and saved for later processing.

Figure 2:
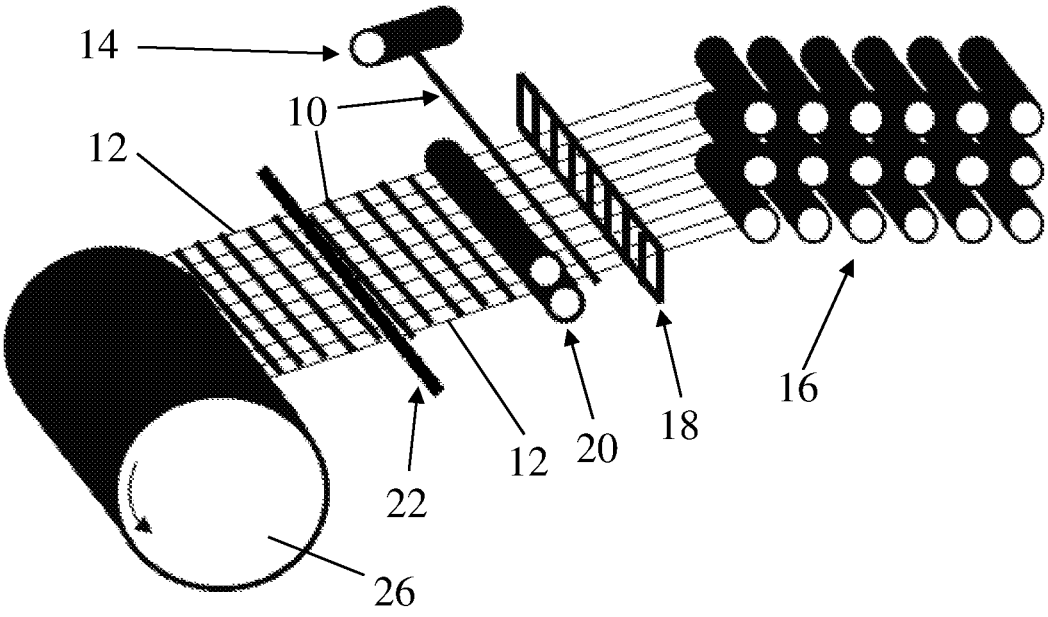
FIG. 2 is a perspective-view schematic representation of a woven fabric having binding elongate bodies in the longitudinal warp direction and high tenacity elongate bodies transversely disposed in the lateral weft direction.

A second embodiment is illustrated in FIG. 2 where the position of the high tenacity elongate bodies 10 and the binding elongate bodies 12 are switched, such that the binding elongate bodies 12 are positioned as the longitudinally extending warp bodies and the high tenacity elongate bodies 10 are transversely disposed as the lateral weft bodies. As illustrated in FIG. 2, the binding elongate bodies 12 are unwound from a plurality of spools that are supported on a plurality of creels 16. An array of binding elongate bodies 12 is led through a heddle 18 which separates adjacent binding elongate bodies 12 so that they are spaced apart by at least about 2 mm, more preferably from about 3 mm to about 30 mm and most preferably from about 4 mm to about 20 mm. As stated previously, spacing beyond the maximum spacing limit may result in an open woven fabric having insufficient mechanical strength. Spacing below the minimum spacing limit may result in an open woven fabric having greater than 10% thermoplastic binding resin content.

Referring again to FIG. 2, after the binding elongate bodies 12 pass through the heddle 18, the high tenacity binding elongate bodies 10 are transversely interwoven with the binding elongate bodies 12 according to standard weaving techniques. The high tenacity binding elongate bodies 10 are unwound from one or more spools that are supported on one or more creels 14. Just as in the first embodiment of FIG. 1, the weaving process of this second embodiment positions one long, continuous weft strand between each pair of adjacent warp strands across the full width of the array of binding elongate bodies 12. After passing the weft strand once across the array of warp strands, the weaving machine turns the weft strand, reversing direction and passing back across the array of warp strands in the opposite direction. This forms selvage loops at the side edges of the woven fabric which are typically trimmed or cut off during further processing. When the selvage loops are trimmed or cut off, the resulting structure incorporates a plurality of discontinuous weft bodies in a substantially parallel array. When the selvage loops are not trimmed or cut off, the resulting structure incorporates a single weft elongate body having a plurality of weft body portions where the weft body portions are in a substantially parallel array. Such weft body portions of one long, continuous weft body that are transversely disposed relative to the longitudinal warp bodies are to be interpreted as being a plurality of lateral weft bodies.

The weaving equipment is set to space longitudinal edges of adjacent high tenacity elongate bodies 10 (such as adjacent parallel portions of one continuous elongate body 10) apart from each other by at least about 10% of the width of the high tenacity bodies, more preferably at least about 15% of the width of the high tenacity bodies, still more preferably from about 15% to about 50% of the width of the high tenacity bodies, and most preferably from about 20% to about 30% of the width of the high tenacity bodies. In preferred embodiments of the invention, these width percentages of separation measure to a separation of at least about 0.5 mm, more preferably 1 mm and still more preferably greater than 1 mm. Still more preferably, the weaving equipment separates adjacent high tenacity elongate bodies 10 so that they are spaced apart at their nearest longitudinal edges by at least about 1.5 mm, more preferably at least about 2 mm, more preferably from about 3 mm to about 30 mm and most preferably from about 4 mm to about 20 mm.

The separation of adjacent high tenacity elongate bodies 10 must be greater than about 10% of the width of the high tenacity bodies to ensure that the subsequent thermal fusion step preferably achieves a full and complete closure of the space between adjacent high tenacity elongate bodies 10 so that abutting edges of the elongate bodies 10 press against each other such that they are substantially in contact with each other without overlapping. Full, complete closure is not mandatory but is most preferred. The separation must be less than about 50% of the width of the high tenacity bodies to ensure that the thermal fusion step fully closes the space between all adjacent high tenacity elongate bodies 10 to achieve a fully closed, gapless woven fabric structure.

Whether the binding elongate bodies are single component thermoplastic bodies or bi-component elongate bodies, the high tenacity elongate bodies preferably comprise at least about 90% by weight of the fabric, more preferably greater than about 90% by weight of the fabric, still more preferably at least about 95% by weight of the fabric, still more preferably at least about 98% by weight of the fabric, and most preferably at least about 99% by weight of the fabric. In this regard, the binding elongate bodies are preferably incorporated at a pick per inch (ppi) of from about 5 picks per inch to about 15 picks per inch, preferably from about 5 picks per inch to about 10 picks per inch, or alternatively from about 10 picks per inch to about 15 picks per inch.

After the high tenacity elongate bodies 10 are woven through the binding elongate bodies 12 in the weft direction, the high tenacity elongate bodies 10 and binding elongate bodies 12 are thermally bonded together at their points of intersection by at least partially melting the thermoplastic polymer component of the binding elongate bodies 12 with a heating element 22, thereby activating the thermoplastic polymer so that it is capable of adhering to the high tenacity elongate bodies 10, and then allowing the melted thermoplastic polymer of the binding elongate bodies 12 to solidify. Once the polymer is solidified at the warp-weft body junction point, the binding elongate bodies 12 are bonded to the high tenacity elongate bodies 14, thereby forming a second dimensionally stable open woven fabric. Bonding methods are the same as described for the first embodiment. The resulting second dimensionally stable open woven fabric is then preferably wound onto a second storage roll 26 and saved for later processing.

In each embodiment, optional tension rolls 20 may be provided to provide tension to the warp fibers and assist in pulling the warp fibers toward first storage roll 24 or second storage roll 26, respectively. Although the optional tension rolls 20 are illustrated in FIGS. 1 and 2 as being positioned between the heddle 18 and heating element 22, this position is only exemplary and may be placed in other locations or entirely eliminated as would be determined by one skilled in the art.

The woven fabrics produced according to each of these two embodiments (one with the high tenacity elongate bodies in the warp direction and the other with the high tenacity elongate bodies in the weft direction) are open fabrics having spaces or holes defined by the spacing of adjacent warp bodies and the spacing of adjacent weft bodies. In accordance with the present invention, the open fabric structures are then heated and pressed under conditions sufficient to flatten the thermoplastic, high tenacity elongate bodies and thereby close the holes by causing edges of the adjacent high tenacity elongate bodies to contact each other. This thermal fusion may be performed on a single open fabric to form a single closed, thermally fused sheet or may be performed on multiple adjoined open fabrics together to form a closed, thermally fused multilayer article in one step as illustrated in FIG. 3.

Figure 3:
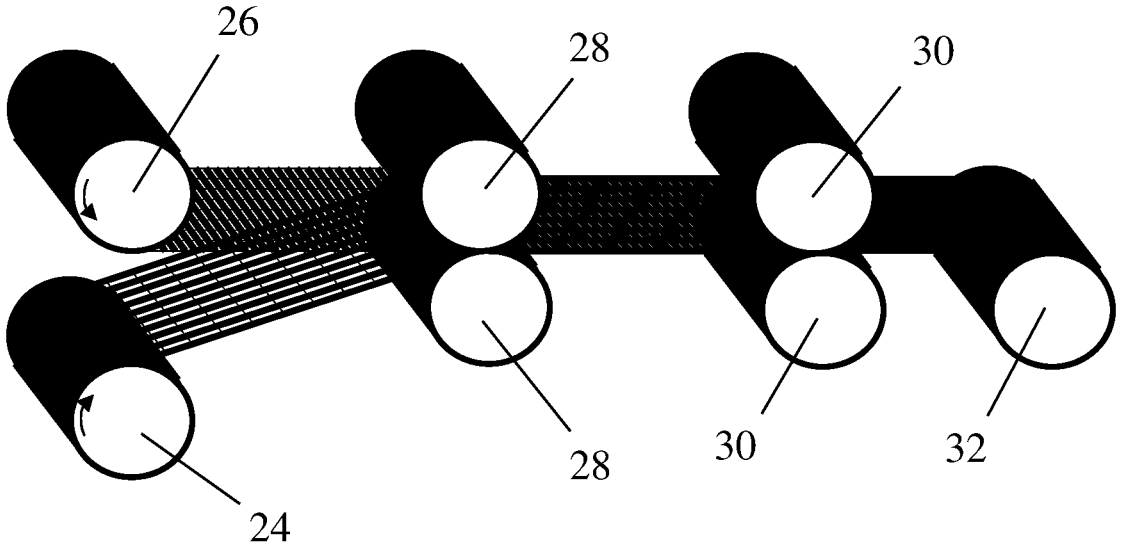
FIG. 3 is a perspective-view schematic representation illustrating the formation of a multi-layer fabric where a first woven fabric having high tenacity elongate bodies in the longitudinal warp direction is thermally fused together with a second woven fabric having high tenacity elongate bodies in the lateral weft direction.

As illustrated in FIG. 3, the thermal fusion process is preferably conducted as a continuous process where a first dimensionally stable open woven fabric having high tenacity elongate bodies as the warp bodies is unwound from a first storage roll 24 and a second dimensionally stable open fabric having binding elongate bodies as the warp bodies is unwound from a second storage roll 26, with the two fabrics being adjoined or attached to each other by passing through rolls 28. Rolls 28 are preferably heated to a temperature that is below the melting point of the high tenacity elongate bodies and above the melting point of the thermoplastic polymer component of the binding elongate bodies. More preferably rolls 28 are heated at a temperature that is more than 10° C. below the melting temperature of the high tenacity elongation bodies, and most preferably at a temperature that is more than 5° C. below the melting temperature of the high tenacity elongation bodies to soften the thermoplastic polymer forming the high tenacity elongate bodies and at least partially melt the thermoplastic component of the binding elongate bodies as the fabrics pass through the rolls without melting the high tenacity elongate bodies. The most suitable temperature will vary depending on the melting point of the polymer used to form the high tenacity elongate bodies, and the temperature should be a few degrees below the melting point of the polymer. In the preferred embodiments, such temperatures for roll 28 are preferably from about 200° F. (~93° C.) to about 350° F. (~177° C.), more preferably from about 200° F. to about 315° F. (~157° C.), still more preferably from about 250° F. (~121° C.) to about 315° F., and most preferably from about 280° F. (~138° C.) to about 310° F. (~154° C.). Rolls 28 also preferably exert light pressure on the combined fabrics to attach them to each other.

The adjoined/attached, heated fabrics are then continuously passed through pressure rolls 30, pressing them together at a pressure of from about 50 psi (344.7 kPa) to about 50,000 psi (344.7 MPa), more preferably about 500 psi (3.447 MPa) to about 20,000 psi (137.9 MPa) and most preferably from about 1,000 psi (6.895 MPa) to about 10,000 psi (68.957 MPa). Rolls 30 are also preferably heated to a temperature that is below the melting point of the high tenacity elongate bodies and above the melting point of the thermoplastic polymer component of the binding elongate bodies. More preferably, rolls 30 are heated at a temperature that is more than 5° C. below the melting temperature of the high tenacity elongation bodies, and most preferably at a temperature that is more than 3° C. below the melting temperature of the high tenacity elongation bodies to soften the thermoplastic polymer forming the high tenacity elongate bodies and at least partially melt the thermoplastic component of the binding elongate bodies as the fabrics pass through the rolls without melting the high tenacity elongate bodies. Pressing the adjoined fabrics between heated pressure rolls 30 produces a thermally fused sheet having, most preferably, no gaps between the warp elongate bodies without the bodies overlapping. If necessary, in each embodiment of the invention, the fabric may be passed through rolls 30 multiple times (or through additional rolls 30) to achieve the preferred gapless, fully closed sheet structure. Driven roll 32 collects the fused sheet and provides a controlled tension in the sheet. The sheet is cooled to below the melting temperature of the thermoplastic component of the binding elongate bodies before contact with driven roll 32. In addition to the multi-stage continuous pressing process illustrated in FIG. 3, it is possible to adjoin and flatten the two dimensionally stable fabrics in a single continuous pressing stage.

Figure 4:
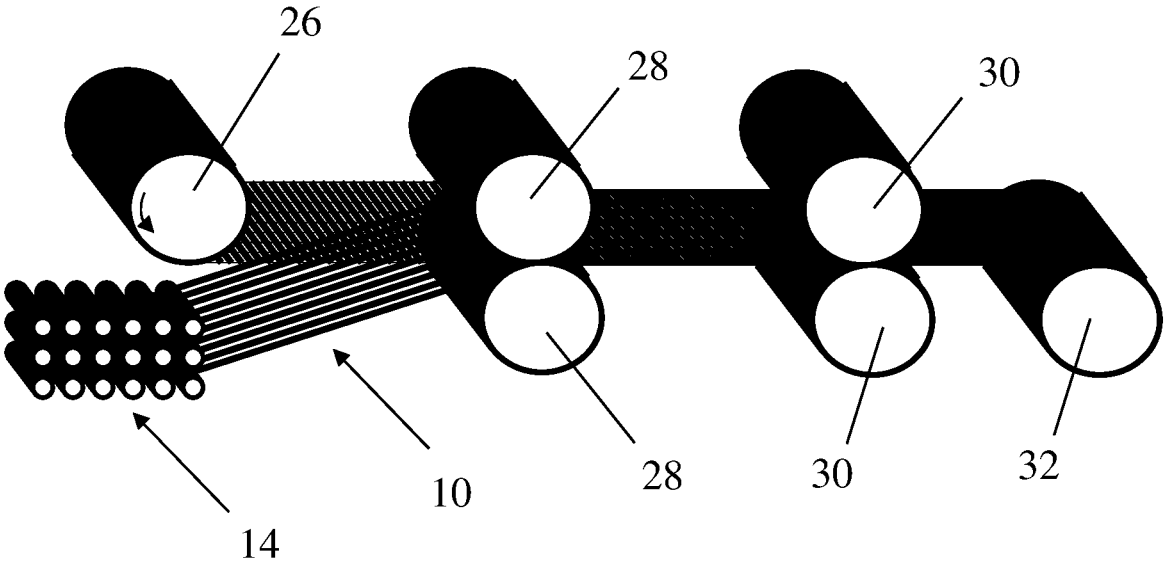
FIG. 4 is a perspective-view schematic representation illustrating the formation of a composite where a woven fabric having high tenacity elongate bodies in the lateral weft direction is thermally fused with a unidirectional array of longitudinal high tenacity elongate bodies supplied from a creel.

As illustrated in FIG. 4, the thermal fusion process may also be conducted as a continuous process where a parallel, evenly spaced arrangement of high tenacity elongate bodies is unwound from a multi-spool creel 14 and a dimensionally stable, open woven fabric having binding elongate bodies as the warp bodies is unwound from a second storage roll 26, with the high tenacity bodies and the open woven fabric being adjoined or attached to each other by passing through heated rolls 28. Rolls 28 preferably exert light pressure on the combined fabrics to attach them to each other. The adjoined/attached, heated fabrics are then continuously passed through pressure rolls 30, pressing them together with heat and pressure as defined above to form a fused sheet. Driven roll 32 collects the fused sheet and provides a controlled tension in the sheet. The sheet is cooled to below the melting temperature of the thermoplastic component of the binding elongate bodies before contact with roll 32.

In addition to the multi-stage continuous pressing process illustrated in FIG. 4, it is possible to adjoin and flatten the two layers in a single continuous pressing stage. In addition to the continuous process examples given in FIG. 3 and FIG. 4, multi-stage and single-stage batch processes using heated-platen presses can also be used to adjoin and flatten two or more layers of dimensionally stable fabrics of this invention. In each of the continuous roll processes described herein, the duration of passage through rolls 30 and optional rolls 28 will be at a rate of from about 1 meter/minute to about 100 meters/minute, more preferably from about 2 meters/minute to about 50 meters/minute, still more preferably from about 3 meters/minute to about 50 meters/min, still more preferably from about 4 meters/minute to about 30 meters/minute, and most preferably from about 5 meters/minute to about 20 meters/minute.

In accordance with the invention, pressing the softened, spaced apart high tenacity elongate bodies 10 with sufficient pressure will flatten them, reducing them in thickness while increasing them in width, whereby the space between adjacent high tenacity elongate bodies is substantially eliminated, and most preferably completely eliminated. Due to such flattening and expansion of the width of the high tenacity elongate bodies, the nearest longitudinal edges of adjacent the high tenacity elongate bodies are brought into contact with each other whereby there are substantially no gaps between said adjacent high tenacity elongate bodies and wherein said adjacent high tenacity elongate bodies do not overlap, achieving a closed, thermally fused sheet. The thermal pressing step will most preferably also flatten the binding elongate bodies 14 without breaking the binding elongate bodies so that the binding elongate bodies 14 remain in their fiber/yarn/tape form in the closed, thermally fused article. To achieve this preferred retention of the form of the binding elongate bodies 14, the thermoplastic polymer comprising the binding elongate bodies 14 should have a melting point within 10° C., and most preferably within 5° C., of the temperature used during thermal pressing. Also, the binding elongate bodies preferably have a denier of from about 20 to about 2000, more preferably from about 50 to about 500, still more preferably from about 60 to about 400, and most preferably from about 70 to about 300.

The high tenacity elongate bodies, including high tenacity fibers, yarns and tapes, may be of any suitable denier. For example, fibers/yarns may have a denier of from about 50 to about 10,000 denier, more preferably from about 200 to 5,000 denier, still more preferably from about 650 to about 4,000 denier, and most preferably from about 800 to about 3,000 denier. Tapes may have deniers from about 50 to about 30,000, more preferably from about 200 to 10,000 denier, still more preferably from about 650 to about 5,000 denier, and most preferably from about 800 to about 3,000 denier. The selection is governed by considerations of ballistic effectiveness and cost. Finer fibers/yarns/tapes are more costly to manufacture and to weave, but can produce greater ballistic effectiveness per unit weight. Multifilament tapes are typically formed by thermally fusing together from 2 to about 1000 filaments, more preferably from 30 to 500 filaments, still more preferably from 100 to 500 filaments, still more preferably from about 100 filaments to about 250 filaments and most preferably from about 120 to about 240 filaments. The greater number of filaments typically translates to higher tape deniers.

As the thermal pressing step will reduce the thickness of the elongate bodies, it will also reduce the thickness of the overall woven structure. The thickness of the open fabrics and closed, thermally fused sheets will correspond to the thickness of the individual high tenacity elongate bodies before and after flattening, respectively. A preferred open woven fabric will have a preferred thickness of from about 10 μm to about 600 μm, more preferably from about 20 μm to about 385 μm and most preferably from about 30 μm to about 255 μm. A preferred closed, thermally fused sheet will have a preferred thickness of from about 5 μm to about 500 μm, more preferably from about 10 μm to about 250 μm and most preferably from about 15 μm to about 150 μm.

A plurality of such single layer or multilayer closed, thermally fused sheets may be fabricated according to the methods described herein, then stacked on top of each other coextensively and consolidated to form a ballistic resistant article having superior ballistic penetration resistance. For the purposes of the invention, articles that have superior ballistic penetration resistance describe those which exhibit excellent properties against deformable projectiles, such as bullets, and against penetration of fragments, such as shrapnel.

As used herein, "consolidating" refers to combining a plurality of fabrics into a single unitary structure. For the purposes of this invention, consolidation can occur with heat and/or pressure or without heat and/or pressure and with or without an intermediate adhesive between fabrics/sheets. For example, the fused sheets may be glued together, as is the case in a wet lamination process. Due to the unique process used to form the closed, thermally fused sheets, it is a unique feature of this invention that an intermediate adhesive coating is optional and not required to form a ballistic resistant article. The flat structure of the fused sheets allows them to be merely hot-pressed together with sufficient bonding according to conventional consolidation conditions. Consolidation may be done at temperatures ranging from about 50° C. to about 175° C., preferably from about 105° C. to about 175° C., and at pressures ranging from about 5 psig (0.034 MPa) to about 2500 psig (17 MPa), for from about 0.01 seconds to about 24 hours, preferably from about 0.02 seconds to about 2 hours. As is conventionally known in the art, consolidation may be conducted in a calender set, a flat-bed laminator, a press or in an autoclave. Consolidation may also be conducted by vacuum molding the material in a mold that is placed under a vacuum. Vacuum molding technology is well known in the art.

To the extent that an intermediate adhesive is used, ballistic resistant articles of the invention may be consolidated with a lower quantity of adhesive resin than is typically needed for forming articles from un-fused, uncompressed sheets because the adhesive need only be applied as a surface layer without impregnating or coating the individual component filaments of the component elongate bodies to promote bonding of one closed sheet to another closed sheet. Accordingly, the total weight of an adhesive or binder coating in a composite preferably comprises from about 0% to about 10%, still more preferably from about 0% to about 5% by total weight of the component filaments plus the weight of the coating. Even more preferably, ballistic resistant articles of the invention comprise from about 0% to about 2% by weight of an adhesive coating, or about 0% to about 1% by weight, or only about 1% to about 2% by weight.

Suitable adhesive materials include both low modulus materials and high modulus materials. Low modulus adhesive materials generally have a tensile modulus of about 6,000 psi (41.4 MPa) or less according to ASTM D638 testing procedures and are typically employed for the fabrication of soft, flexible armor, such as ballistic resistant vests. High modulus adhesive materials generally have a higher initial tensile modulus than 6,000 psi and are typically employed for the fabrication of rigid, hard armor articles, such as helmets.

Representative examples of low modulus adhesive materials include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly (isobutylene-co-isoprene), polyacrylates, polyesters, polyethers, fluoroelastomers, silicone elastomers, copolymers of ethylene, polyamides (useful with some filament types), acrylonitrile butadiene styrene, styrene-isoprene-styrene (SIS) block copolymers, elastomeric polyurethanes, polycarbonates, acrylic polymers, acrylic copolymers, acrylic polymers modified with non-acrylic monomers, and combinations thereof, as well as other low modulus polymers and copolymers curable below the melting point of the non-polymeric tapes or of the filaments forming the tapes. Also preferred are blends of different elastomeric materials, or blends of elastomeric materials with one or more thermoplastics. Particularly preferred are polystyrene-polyisoprene-polystyrene-block copolymers sold under the trademark KRATON® from Kraton Polymers of Houston, Tex. Each of these materials is also suitable as the thermoplastic polymer component of the binding elongate bodies.

Preferred high modulus binder materials include polyurethanes (both ether and ester based), epoxies, polyacrylates, phenolic/polyvinyl butyral (PVB) polymers, vinyl ester polymers, styrene-butadiene block copolymers, as well as mixtures of polymers such as vinyl ester and diallyl phthalate or phenol formaldehyde and polyvinyl butyral. Particularly suitable rigid polymeric binder materials are those described in U.S. Pat. No. 6,642,159, the disclosure of which is incorporated herein by reference to the extent consistent herewith. A polymeric adhesive material may be applied according to conventional methods in the art.

When forming a multilayer article, a plurality of fabrics are overlapped atop each other, most preferably in coextensive fashion, and consolidated into single-layer, monolithic element. In the most preferred embodiments, the high tenacity elongate bodies of a first fabric are perpendicular to the high tenacity elongate bodies of a second, adjacent fabric (i.e. 0°/90° high tenacity body orientations relative to the longitudinal axis of the bodies of each fabric, respectively), and this structure continues so that the high tenacity elongate bodies in all odd numbered layers are oriented in the same direction and the high tenacity elongate bodies in all even numbered layers are oriented in the same direction. Although orthogonal 0°/90° elongate body orientations are preferred, adjacent fabrics can be aligned at virtually any angle between about 0° and about 90° with respect to the central longitudinal axis of the high tenacity elongate bodies of another fabric. For example, a five fabric structure may have fabrics oriented at a 0°/45°/90°/45°/0° or at other angles, such as rotations of adjacent fabrics in 15° or 30° increments, with respect to the longitudinal axis of the high tenacity elongate bodies. Such rotated unidirectional alignments are described, for example, in U.S. Pat. Nos. 4,457,985; 4,748,064; 4,916,000; 4,403,012; 4,623,574; and 4,737,402, all of which are incorporated herein by reference to the extent not incompatible herewith.

Ballistic resistant, multilayer articles of the invention will typically include from about from about 2 to about 100 of the closed, thermally fused sheets (layers), more preferably from about 2 to about 85 layers, and most preferably from about 2 to about 65 layers. The greater the number of plies translates into greater ballistic resistance, but also greater weight. The number of layers also affects the areal density of the composites, and the number of layers forming a desired composite will vary depending upon the ultimate end use of the desired ballistic resistant article. Minimum levels of body armor ballistic resistance for military use are categorized by National Institute of Justice (NIJ) Threat Levels, as is well known in the art.

Multilayer articles of the invention comprising a consolidated plurality of closed, thermally fused sheets of the invention preferably have an areal density of at least 100 $g/m^2$, preferably having an areal density of at least 200 $g/m^2$ and more preferably having an areal density of at least 976 $g/m^2$. Most preferably, such multilayer articles have an areal density of at least 4000 $g/m^2$ (4.0 ksm)(about 0.82 psf). In preferred embodiments, multilayer articles of the invention have an areal density of from about 0.2 psf (0.976 ksm) to about 8.0 psf (39.04 ksm), more preferably from about 0.3 psf (1.464 ksm) to about 6.0 psf (29.28 ksm), still more preferably from about 0.5 psf (2.44 ksm) to about 5.0 psf (24.4 ksm), still more preferably from about 0.5 psf (2.44 ksm) to about 3.5 psf (17.08 ksm), still more preferably from about 1.0 psf (4.88 ksm) to about 3.0 psf (14.64 ksm), and still more preferably from about 1.5 psf (7.32 ksm) to about 3.0 psf (14.64 ksm).

Articles of the invention may be formed from a plurality of closed, thermally fused sheets that comprise only one type of high tenacity elongate body and one type of binding elongate body or from a plurality of hybridized closed, thermally fused sheets that individually comprise multiple different high tenacity elongate body types in a single structure and/or multiple different binding elongate body types in a single structure. For example, closed, thermally fused sheets may be fabricated from open, woven fabrics that include at least two different polymeric tape types wherein a first tape type has a first number of twists per inch of yarn length and a second tape type has a second number of twists per inch of yarn length, wherein the first number of twists and the second number of twists per inch of yarn length are different. Alternatively, an article may be fabricated from at least two different polymeric tape types where each polymeric tape type has the same number of twists per inch of yarn length, but where the tapes comprise different filament polymer types, such as a combination of UHMW PE tapes and polypropylene-based tapes. In still another alternative embodiment, woven fabrics may be fabricated from a combination of fibrous tapes and non-fibrous tapes.

The multilayer composite articles of the invention may be used in various applications to form a variety of different ballistic resistant articles using well known techniques, including flexible, soft armor articles as well as rigid, hard armor articles. For example, suitable techniques for forming ballistic resistant articles are described in, for example, U.S. Pat. Nos. 4,623,574, 4,650,710, 4,748,064, 5,552,208, 5,587,230, 6,642,159, 6,841,492 and 6,846,758, all of which are incorporated herein by reference to the extent not incompatible herewith. The composites are particularly useful for the formation of hard armor and shaped or unshaped subassembly intermediates formed in the process of fabricating hard armor articles. By "hard" armor is meant an article, such as helmets, panels for military vehicles, or protective shields, which have sufficient mechanical strength so that it maintains structural rigidity when subjected to a significant amount of stress and is capable of being freestanding without collapsing. Such hard articles are preferably, but not exclusively, formed using a high tensile modulus binder material. The structures can be cut into a plurality of discrete sheets and stacked for formation into an article or they can be formed into a precursor which is subsequently used to form an article. Such techniques are well known in the art.

The following examples serve to illustrate the invention.

EXAMPLES

Spools of high tenacity UHMWPE fibrous tape having a tenacity of approximately 33 g/denier were arranged in a creel. The tapes averaged about 0.15 inch wide and were made according to a process described in U.S. Pat. No. 8,236,119. A plurality of the fibrous tapes were issued from the creel, arranged into a parallel array and fed to the header of a weaving machine set for 5.5 tapes per inch in the warp direction with the tapes being spaced apart. Binding fibers, i.e. EVA coated glass fibers having a denier of 225 were, interwoven in the fill (weft) direction at 7 fibers per inch. The resulting open woven fabric was about 16 inches wide.

During the weaving process, as the woven fabric advanced toward a fabric take up roll, the EVA adhesive coating of the binding fibers was activated (melted) by a radiant heater positioned in the fill direction. This bonded the binding fibers to the high tenacity tapes, which bound the high tenacity tapes together and stabilized the fabric with fixed gaps between the tapes.

A 16 inch by 16 inch (L×W) sample of this fabric was pressed for about 10 minutes under a pressure of about 5,000 psi at 300° F., flattening the high tenacity tapes and resulting in a closed, fused sheet with substantially no gaps between the flattened high tenacity tapes. Various specifications for the open, woven fabric and the closed, pressed fabric are identified in Table 1.

TABLE 1

| Measurement | Units | Open Woven Fabric | Thermally Pressed Fabric |
|---|---|---|---|
| Tape Count | Tapes/Inch | 5.5 | 5.5 |
| Coated Fiber Count | Fibers/Inch | 7 | 7 |
| Gap between Tapes | Inch | 0.032 | 0 |
| Gap between Tapes | % of tape width | 21.2 | 0 |
| Fabric Thickness | Inch | 0.007 | 0.004 |
| Tape Width | Inch | 0.15 | 0.182 |
| Tape Aspect Ratio | — | 75:1 | 100:1 |

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A process for forming a closed, thermally fused multilayer article comprising:

a) providing a woven fabric comprising high tenacity elongate bodies having a width and being interwoven with transversely disposed binding elongate bodies, said high tenacity elongate bodies comprising a thermoplastic polymer, having a tenacity of at least about 14 g/denier and having a tensile modulus of at least about 300 g/denier, wherein adjacent high tenacity elongate bodies are spaced apart from each other by a distance equivalent to at least about 10% of the width of the high tenacity elongate bodies; and wherein said binding elongate bodies at least partially comprise a thermoplastic polymer having a melting temperature below a melting temperature of the high tenacity elongate bodies;

b) at least partially melting the thermoplastic polymer of the binding elongate bodies;

c) allowing the melted thermoplastic polymer of the binding elongate bodies to solidify, whereby the binding elongate bodies are bonded to the high tenacity elongate bodies, thereby forming a first dimensionally stable open fabric; and d) repeating steps a)-c) to form a second dimensionally stable open fabric;

e) adjoining said first dimensionally stable open fabric with said second dimensionally stable open fabric, wherein the high tenacity elongate bodies of the first fabric are oriented at a non-parallel angle relative to the high tenacity elongate bodies of the second fabric, and thermally pressing the adjoined fabrics under conditions sufficient to attach the first fabric to the second fabric and to flatten the high tenacity elongate bodies in each fabric respectively, thereby causing longitudinal edges of the adjacent high tenacity elongate bodies in each fabric respectively to contact each other, whereby there are no gaps between said adjacent high tenacity elongate bodies in either fabric, achieving a full and complete closure of the spaces between adjacent high tenacity elongate bodies, and wherein said adjacent high tenacity elongate bodies forming each fabric do not overlap.

2. The process of claim 1 wherein all the elongate bodies of the multilayer article are multifilament fibers.

3. A process for forming a closed, fused sheet comprising:

a) providing a woven fabric comprising high tenacity elongate bodies having a width and being interwoven with transversely disposed binding elongate bodies, said high tenacity elongate bodies comprising a thermoplastic polymer, having a tenacity of at least about 14 g/denier and having a tensile modulus of at least about 300 g/denier, wherein adjacent high tenacity elongate bodies are spaced apart from each other by a distance equivalent to at least about 10% of the width of the high tenacity elongate bodies; and wherein said binding elongate bodies at least partially comprise a thermoplastic polymer having a melting temperature below a melting temperature of the high tenacity elongate bodies;

b) at least partially melting the thermoplastic polymer of the binding elongate bodies;

c) allowing the melted thermoplastic polymer of the binding elongate bodies to solidify, whereby the binding elongate bodies are bonded to the high tenacity elongate bodies, thereby forming a dimensionally stable open fabric; and d) pressing the dimensionally stable open fabric under conditions sufficient to flatten the high tenacity elongate bodies, thereby causing longitudinal edges of the adjacent high tenacity elongate bodies to contact each other, whereby there are no gaps between adjacent high tenacity elongate bodies and wherein said adjacent high tenacity elongate bodies do not overlap, thereby forming said closed, fused sheet wherein the spaces between adjacent high tenacity elongate bodies are fully and completely closed.

4. The process of claim 3 wherein all the elongate bodies of said closed, fused sheet are multifilament fibers.

5. A process for forming a closed, fused multilayer article comprising attaching a first closed, fused sheet formed by the process of claim 3 with a second closed, fused sheet of claim 3 wherein each closed, fused sheet is thermally fused and wherein the high tenacity elongate bodies of the first closed, fused sheet are oriented at a non-parallel angle relative to the high tenacity elongate bodies of the second closed, fused sheet.

6. The process of claim 5 wherein all the elongate bodies of the multilayer article are multifilament fibers.

7. A process for forming a closed, thermally fused multilayer article comprising:

a) providing a woven fabric comprising high tenacity elongate bodies having a width and being interwoven with transversely disposed binding elongate bodies, said high tenacity elongate bodies comprising a thermoplastic polymer, said high tenacity elongate bodies having a tenacity of at least about 14 g/denier and having a tensile modulus of at least about 300 g/denier, wherein adjacent high tenacity elongate bodies are spaced apart from each other by a distance equivalent to at least about 10% of the width of the high tenacity elongate bodies; and wherein said binding elongate bodies at least partially comprise a thermoplastic polymer having a melting temperature below a melting temperature of the high tenacity elongate bodies;

b) at least partially melting the thermoplastic polymer of the binding elongate bodies;

c) allowing the melted thermoplastic polymer of the binding elongate bodies to solidify, whereby the binding elongate bodies are bonded to the high tenacity elongate bodies, thereby forming a dimensionally stable open fabric;

d) pressing the dimensionally stable open fabric under conditions sufficient to flatten the high tenacity elongate bodies, thereby causing longitudinal edges of the adjacent high tenacity elongate bodies to contact each other, whereby there are substantially no gaps between adjacent high tenacity elongate bodies and wherein said adjacent high tenacity elongate bodies do not overlap, thereby forming a closed, fused sheet; and adjoining said closed, fused sheet with a web comprising a parallel array of high tenacity elongate bodies, wherein the high tenacity elongate bodies of the web are positioned perpendicular to the high tenacity elongate bodies of the fused sheet, and thermally pressing the adjoined fused sheet and web under conditions sufficient to attach the fused sheet to the web and to flatten the high tenacity elongate bodies of the web, thereby causing longitudinal edges of the adjacent high tenacity elongate bodies in the web to contact each other whereby there are substantially no gaps between said adjacent high tenacity elongate bodies of the web and wherein said adjacent high tenacity elongate bodies of the web do not overlap.

8. The process of claim 7 wherein all the elongate bodies of the multilayer article are multifilament fibers.

* * * * *